United States Patent [19]

Baron et al.

[11] 4,425,229

[45] Jan. 10, 1984

[54] PROCESS FOR THE TREATMENT OF PHOSPHATE ORES WITH CARBONATE OR SILICO-CARBONATE GANGUE

[75] Inventors: Michel Baron; Gérard Baudet; Amar Henchiri, all of Orleans; Pierre-Luc Hergibo, Sandillon, all of France

[73] Assignee: Bureau de Recherches Geologiques et Minieres, Paris, France

[21] Appl. No.: 300,205

[22] Filed: Sep. 8, 1981

[30] Foreign Application Priority Data

Sep. 8, 1980 [FR] France ..... 80 19366

[51] Int. Cl.[3] ..... B03D 1/14

[52] U.S. Cl. ..... 209/167; 209/166; 252/61

[58] Field of Search ..... 252/61; 209/166, 167

[56] References Cited

U.S. PATENT DOCUMENTS

| | | | |
|---|---|---|---|
| 2,026,785 | 1/1936 | Harris | 209/166 |
| 2,288,237 | 6/1942 | Green . | |
| 2,461,813 | 2/1949 | Duke | 209/166 |
| 3,113,838 | 12/1963 | Perri et al. . | |
| 3,462,017 | 8/1969 | Bushell et al. . | |
| 3,732,000 | 5/1973 | Breathitt et al. . | |
| 3,837,488 | 9/1974 | Yang . | |
| 4,144,969 | 3/1979 | Snow . | |
| 4,287,053 | 9/1981 | Lehr et al. | 209/167 |
| 4,324,653 | 4/1982 | Henchiri et al. | 209/167 |

FOREIGN PATENT DOCUMENTS

| | | | |
|---|---|---|---|
| 528295 | 7/1956 | Canada | 209/166 |
| 1175623 | 8/1964 | Fed. Rep. of Germany . | |
| 1039462 | 5/1953 | France . | |
| 2248878 | 5/1975 | France . | |
| 2409090 | 6/1979 | France . | |

*Primary Examiner*—Bernard Nozick
*Attorney, Agent, or Firm*—Frost & Jacobs

[57] ABSTRACT

Process for treating by reverse flotation phosphate ores of the carbonate or silico-carbonate gangue type. It includes the steps of:

(1) conditioning of the ore in a manner known per se with a product acting to depress the phosphate compounds, (2) treatment of the conditioned ore step (1) with a collector essentially comprising a phosphoric ester, (3) flotation of the carbonates, this leading to a flotation residue which contains the phosphate compounds and, if so required, in the case where the starting compound is of the silico-carbonate gangue type, (4) conditioning of said flotation residue by a cationic collector, the possibly present silicates being thus separated by flotation.

The process permits benification of the phosphate ores by a treatment wholly carried out in sea-water.

26 Claims, No Drawings

PROCESS FOR THE TREATMENT OF PHOSPHATE ORES WITH CARBONATE OR SILICO-CARBONATE GANGUE

The invention relates to the field of treatment of phosphate ores. It applies to the phosphate ores of the silico-carbonate or carbonate gangue type and more particularly to the sedimentary ores.

Recovery of sedimentary ores with a carbonate or silico-carbonate gangue raises difficult problems in the present state of mineralurgical techniques. Mention will be made below by way of illustration of some bibliographical references materializing the state of the prior art in this field.

The article in the review "Industrie Minérale Mineralurgie" Sept. 1976, page 113, reports flotation trials effected on Karatau phosphates in the Soviet Union. As a matter of fact, this is one of the most important deposit of carbonate sedimentary phosphates in the world. The ore essentially comprises phosphate-bearing particles, dolomite, calcite and silica under quartz form. A typical chemical composition is the following:

$P_2O_5$: 22–23%
MgO: 2.8–3%
$CO_2$: 8–10%
insolubles: 16.0–20%

Flotation is effected in two stages. The first flotation step is intended to remove the carbonates while leaving as a residue in the cell the phosphates and silicates. The flotation reagent, or collector, is selected among $C_{10}$–$C_{16}$ synthetic fatty acids used in an amount of 0.3 kg/t the pH is set between 4.8 and 5 by means of phosphoric acid. In a second step, the collector is changed, the phosphates are floated with an emulsion of tall-oil in kerosene. The medium is then adjusted to a pH of 7.7 to 8 with soda. Moreover, the silica and silicates are depressed with sodium silicate (in an amount of 0.5 kg/t). The concentrate thus obtained has a 28% $P_2O_5$ grade, with a 75% recovery. Such a process has serious drawbacks. The most important thereof lies in the fact that two different collectors should be used during two successive flotation steps. Moreover, in the first flotation, phosphoric acid is a relatively expensive compound.

Another process was described by A. R. RULE et al, in "Report of investigations 7864" of the United States Bureau of Mines entitled "Flotation of carbonates minerals from unaltered phosphate ores of the phosphoria formation" then in a communication presented by the authors at the Seminary on benefication of lean mineral phosphates with a carbonate gangue type, at the 11th International Congress of Ore Dressing at Cagliari in Apr., 1975.

If so required, those skilled in the art may refer to this article as well as to all the bibliographical references contained therein. In brief, the treatment applies to partially altered phosphates of the Phosphoria formation containing carbonates and silicates. A typical predominating composition is the following:

$P_2O_5$: 24%
CaO: 40.8%
$SiO_2$: 12.8%
MgO: 2.4%

There is first effected an anionic flotation of the carbonates with an emulsion of fatty acids (15%), pine oil (0.5%), and soda (0.5%); the collector is thus a refined fatty acid. The phosphates are depressed with the fluosilicic anion, that is there is added, as a reagent, fluosilicic acid $H_2SiF_6$. The drawback of this compound is that it is a pollutant for the environment, this being a serious counterpoise for the advantage of its low cost. The silicates and phosphates will then remain at the bottom of the flotation cell and constitue the final concentrate.

This concentrate has a 29.1% $P_2O_5$ grade with a recovery of 57.6%. The process yield is poor and there cannot be used a non fluorinated, lowly pollutant depressor, such as sulphuric acid.

This process for reverse flotation of the carbonates which was developed by U.S.B.M. was complemented by a reverse flotation of the silica and silicates using amine acetates as collectors. In its final formulation, said process therefore includes the following steps:

depression of the phosphate by fluosilicic acid flotation of the carbonates by an aqueous emulsion of refined tall-oil (collector with a fatty acids base), of pine oil (frother) and of soda flotation of the silica and silicates by amine acetates.

There may be found a description of this process and of the results afforded thereby on phosphate ores of the U.S. West in the text of a communication to the 1977 Annual Congress of the Society of Mining Engineers of AIME held at Salt Lake City "Recent advances in beneficiation of Western Phosphates" by A. R. RULE D. E. KIRBY and D. C. AHLIN.

On an altered ore comprising calcareous intercalations and with a 22% $P_2O_5$ grade, this process led to a concentrate having a 30% $P_2O_5$ grade with a 72% phosphate recovery.

Since fatty acids are used as collectors for the carbonates, this process cannot be economically used in a seawater medium containing $Ca^{2+}$ – $Mg^{2+}$ cations which will precipitate the fatty acids under the form of insoluble salts.

As a document illustrating the prior art, mention may further be made of U.S. Pat. No. 4,144,969.

The process described in this patent is applied to the purification of phosphate preconcentrates resulting from one or two flotation steps during which the silica was removed. Such preconcentrates contain low amounts of residual carbonates, mostly under the form of dolomite. The process consists in a conditioning of the preconcentrate by a carbonate depressor under the form of a compound containing the F-anion, in successive additions of a cationic collector for apatite, as associated with a liquid hydrocarbon, then in a flotation of the apatite. This process thus involves two or three flotation steps: a direct anionic flotation of the phosphate possibly followed by a cationic flotation for removing the silica and obtaining a preconcentrate of phosphate, this being subjected to a cationic flotation for dolomite removal. On the other hand, the process of U.S. Pat. No. 4,144,969 is essentially applicable to ores having low carbonate contents, for instance to phosphate preconcentrates having a 1 to 3% MgO content. The process described is therefore time-consuming, complicated and limited as to its applications to the purification of phosphate preconcentrates. The use of fluorinated compounds as depressors for the carbonates may raise pollution problems for the water effluents from the washing plant.

It moreover has, for ores having a low content in carbonate impurities, the drawback of floating the phosphate while it would be more advisable for the dimensioning of the treatment circuit, to float the carbonates.

FR Pat. No. 73 38,413 (published under no. 2,248,878) relates to a process for recovery of phosphate ores of the carbonate gangue type. This is a multistage process wherein a reverse flotation is effected, by means of an association of reagents including a collector for flotation of the carbonates and depressors for the phosphates. The ore is, in a first step, treated with simple or complex metal salts, whereafter the pulp issued from this first step is treated by a complex-former, flotation of the carbonates being later effected by means of a suitable collector. The reagents used in such a process are comparatively expensive and, moreover, some of them, in particular the fatty acids or sodium salts of fatty acids are highly sensitive to the hardness of water. This process cannot be used in a sea-water medium, if fatty acids of sodium salts of fatty acids are used as collectors for the carbonates.

Thus, there exists a permanent need for the development of processes for treating phosphate ores of the carbonate or silicocarbonate gangue type which use unexpensive, efficient reagents, even if the treatment is carried out in the presence of sea-water. Of course, it is desirable that, at the same time, the selectivity of the chemical reactants should be suitable to afford separation with a high yield of the phosphate compounds. It goes without saying that the profit-earning capacity of the processes is intimately related to the reagent cost.

Under its general form, the invention has for its object a process for the treatment by reverse flotation of phosphate ores of the carbonate or silico-carbonate gangue type, characterized by the steps of:

(1) conditioning of the ore in a manner known per se with a product depressing the phosphate compounds, (2) treatment of the conditioned ore from step (1) with a collector essentially comprising a phosphoric ester, (3) flotation of the carbonates, this leading to a flotation residue containing the phosphate compounds, and, if so required, in the case where the starting ore is of the silico-carbonate gangue type, (4) conditioning of said flotation residue by a cationic collector, the possibly present silicates being thus separated by flotation.

The process according to the invention uses reverse flotations, the phosphate compounds being always recovered in the non-floating residues of the flotation steps.

In the first step of the process, the ore is conditioned by means of a product acting to depress the phosphate compounds. Such depressor products are known to those skilled in the art. They are essentially products containing fluosilicates, or monometallic phosphates as well as acid products such as sulphuric acid and phosphoric acid. Generally, the duration of this step should be sufficient for the conditioning action to be efficient, reaction times of the order of 1 to 4 minutes being usually satisfactory. The solid matter concentration ranges from 10 to 20% by weight in most cases, as related to the weight of the ore suspension used. The conditioning is effected at the suspension natural pH and the latter will therefore be dependent upon the particular depressor used. In the case of sulphuric and phosphoric acids, the pH will range from about 4.5 to about 6. For the other depressors, e.g. of the sodium fluosilicate type or monosodium phosphate type, the pH will range from about 5.5 to about 7.5. The concentration of the depressor product depends on the nature of said product: for example, sodium fluosilicate may be used in amounts ranging from about 500 to about 1500 g per ton of ore. For sulfuric acid amounts of the order of 1 to 10 kg per ton of ore proved to be satisfactory. All the above mentioned values are related to one ton of solid feed ore.

This first conditioning step provided according to the method of the invention is carried out in an aqueous suspension and it was found that excellent results were obtained with sea-water. Therefore, it is not necessary to use fresh water in this step.

The second step of the process of the invention consists in treating the conditioned ore from the first step, by means of a collector essentially consisting of a phosphoric ester. For the purposes of the invention, there may be used any phosphoric ester or mixture of such esters. It was found that, due to the excellent frothing properties of the phosphoric esters, it was not necessary to add a frother to the ore. Moreover, flotation will operate very well in a sea-water medium, while the heretofore known reagents are much more sensitive to the hardness of the water. The selectivity of these known reagents therefore tend to decrease considerably if using sea-water. Contrarily in the process of the invention, the phosphoric esters are much more less sensitive to water hardness and afford a selectivity perfectly suited to the requirements.

The concentration of collector phosphoric esters advantageously ranges from 100 g to 2500 g per ton, the reference still being the ton of solid feed-ore. Such a concentration range is satisfactory from the economical standpoint, for while the phosphoric esters are more expensive products than the fatty acids, the latter should be used as flotation collectors in much higher amounts. In addition, as previously-mentioned, they are much more sensitive to water hardness.

The solid concentration in this second step of the process of the invention advantageously ranges from 10 to 20% by weight. As regards the duration of the step of treatment with phosphoric ester, it depends on the nature of the latter but it was found in practice that conditioning times of 1 to 4 minutes were suitable. Another advantage of the invention is that this step can be carried out at the pH of the pulp resulting from the first conditioning step and it is therefore unnecessary to add a pH adjusting product.

For the practical purposes of the invention, there was used to advantage phosphoric esters essentially consisting of alkylphosphates, e.g. $C_8$—$C_{20}$ alkylphosphates. Such products are commercially available under the form of mixtures of monoesters and di-esters.

Other phosphoric esters, which proved to be useful as flotation collectors are organic phosphates having included in their chain alkylene oxide units, preferably ethylene oxide units. Such compounds are well known and may be prepared either by alkylene oxide condensation on phosphates having a linear chain, a branched chain or a chain including aromatic groups, or by phosphatation of alkylene oxide condensates on aliphatic alcohols, cycloaliphatic alcohols or aliphatic and aromatic alcohols. The main processes for preparing such compounds are described in the work "Anionic Surfactants" part II, Chapter 15, by W. M. LINFIELD, Marcel DEKKER INC. editor.

The number of alkylene oxide units, in particular ethylene oxide units, present in the phosphoric ester chain has an influence on the solubilization properties of the ester. Good results were obtained with phosphates including 4 to 12 moles of ethylene oxide and $C_{10}$—$C_{15}$ hydrocarbon chains.

Particular phosphoric ester products suitable for the purposes of the invention are notably marketed under the trade names HOE F 1415 and HOE F 2711 of Hoechst (Germany) as well as BEYCOSTAT of LP9A, LP4A NA or DA type of Societe Gerland (France).

In the third step of the process according to the invention, the carbonates are separated by flotation. If starting from a phosphate ore of the carbonate gangue type, this step is the final step of the process and there is recovered with a high yield a residue containing the phosphate compounds. This carbonate flotation step uses means known by those skilled in the art.

Flotation may be effected in a single roughing step if removal of the carbonates into the froths is satisfactory; in this case, no addition of supplementary phosphoric ester collector is effected further to the addition made at conditioning step (2).

If the carbonate removal is insufficient at completion of the roughing flotation, then the non-floating residue is conditioned either by a further addition of phosphoric ester collector for one to three minutes, or by a further addition of depressor for one to two minutes followed by a further addition of phosphoric ester collector for one to three minutes. The residue pulp thus conditioned is subjected to a depletion flotation for removing the carbonates for one to five minutes. The depressor and collector reagents used for the conditioning steps prior to the depletion flotation are the same as those used in steps (1) and (2) of conditioning preliminary to the roughing flotation. As phosphate depressor there may be used sodium fluosilicate, fluosilicic acid, phosphoric acid, monosodium, monopotassium-or monoammonium-phosphates and sulphuric acid. As carbonate collector use is made of phosphoric esters, polyoxyalkylene phosphoric esters and preferably polyoxyethylene phosphoric esters such as the commercial products-HOE F 1415 and HOE F 2711 of the firm Hoechst, BEYCOSTAT LP4A. LP9A-NA-DA of Société GERLAND.

The carbonate roughing flotation may be followed by one or more depletion flotations until the utmost removal of the carbonates.

If the starting ore is of the silicocarbonate gangue type, then it is necessary to provide a step for separating the silicates from the phosphates. In this final step, the non-floating portion including the phosphate and silicate compounds is conditioned with a cationic collector of a type know per se. The best results are obtained with primary amines or salts thereof, e.g. amine carboxylates, such as primary amine acetates. For practically carrying out this final step, the product issuing from the carbonate separation and which contains silicates and phosphates is concentrated until obtention of a product including from 50 to 70% of solids. The most part of the water is therefore removed by known means for example hydrocycloning, decanting or filtration. The thus thickened product is rediluted with water to provide a solid concentration of the order of 10 to 20% by weight, the pH of this pulp preferably ranging from 6.5 to 8. Flotation is then effected with the cationic collector for the silicate matter. Recovered in the pulp froths are the silica and silicates which are separated. The nonfloating portion forms the sought phosphate concentrate.

The process of the invention allows the recovering of the phosphate ores of the carbonate or silico-carbonate gangue type with high yield and selectivity. For example, starting from a carbonate gangue ore, with about 19% $P_2O_5$ grade, there may be recovered a concentrate with a $P_2O_5$ grade above 30% with a recovery of about 75%.

The invention will be now illustrated by no way of limitation by the examples given below.

EXAMPLE 1

This example involved treatment of the fine fraction of a carbonate gangue ore from the Pacific Islands (French Pacific Territories).

(a) The fraction of a $-315+40$ μm grain-size, consisting of 50% of apatite and 50% of carbonates essentially under the form of calcite, is conditioned as seawater pulp having a 10% solid concentration (pH 7.85) successively:

with sodium fluosilicate, at a 1200 g/t dosage acting as an apatite depressor, during 3 minutes (pH 6.97).

with a phosphoric ester marketed under the name HOE F 1415 (HOECHS), at a 800 g/t dosage acting as a collector for the carbonates, during 3 minutes (pH 6.85).

The conditioned pulp is subjected for 1.5 minute to a roughing flotation providing a floating fraction F1 essentially consisting of carbonates and a non-floating fraction NF 1 essentially consisting of apatite. The material and phosphate balance are the following (table I).

TABLE I

| | Ponderal yield Δ P % | $P_2O_5$ content % | $P_2O_5$ recovery % |
|---|---|---|---|
| Feed-stock | 100.00 | 19.14 | 100.00 |
| Floating F1 (sterile) | 53.50 | 9.00 | 25.16 |
| Non-floating NF1 (concentrate) | 46.50 | 30.80 | 74.84 |

The same mineral as that used in example (1a) is treated by the process described in example (1a), but replacing the sodium fluosilicate used as a depressor by technical 85% phosphoric acid, at 8000 g/t pH during conditioning: 5.67). The phosphoric ester of HOE F 1415 was at a 1,000 g/t dosage pH: 5.83).

Flotation conditions are identical with example (1a). The separation balances are in Table II below.

TABLE II

| | Ponderal yield Δ P % | $P_2O_5$ content % | $P_2O_5$ recovery % |
|---|---|---|---|
| Feed-stock | 100,00 | 16.98 | 100.00 |
| Floating F1 (sterile) | 48.60 | 10.27 | 26.29 |
| Non-floating NF1 (concentrate) | 51.40 | 27.22 | 73.71 |

The same mineral as that used in example (1a) is treated according to the process described in example (1a). Monosodium phosphate at a 1,050 g/t dosage is used as a phosphate depressor (pH during conditioning: 5.71).

The phosphoric ester HOE F 1415 was at a 1000 g/t dosage (pH during conditioning: 5.91). The other conditions for flotation are identical with those in example 1a). The balances of separation are set forth in table III below.

TABLE III

| | Ponderal yield ΔP % | $P_2O_5$ content % | $P_2O_5$ recovery % |
|---|---|---|---|
| Feed-stock | 100.00 | 19.35 | 100.00 |
| Floating F1 (sterile) | 42,23 | 8.45 | 18.44 |

TABLE III-continued

| | Ponderal yield ΔP % | $P_2O_5$ content % | $P_2O_5$ recovery % |
|---|---|---|---|
| Non-floating NF1 (concentrate) | 57.77 | 27.33 | 81.56 |

EXAMPLE 2

A second sample of the same ore as in example 1, at a −315+40 μm grain-size, consisting of 60% of apatite and 40% carbonates, is conditioned in sea-water pulp at a solid concentration of 15% (pH: 7.70) successively:

with sodium fluosilicate at a 1,000 g/t dosage during 4 minutes (pH: 7).

with a phosphoric ester, marketed by Societe GERLAND under the name "Beycostat LP9A", at a 1,200 g/t dosage during 2 minutes (pH: 6.90).

The conditioning pulp is subjected for 3 minutes to a roughing flotation providing a floating fraction F1 which is sterile and a non-floating fraction NF1 which essentially consists of apatite (86%). The weight and phosphate balances are as follows (table IV).

TABLE IV

| | Ponderal yield Δ P % | $P_2O_5$ content % | $P_2O_5$ recovery % |
|---|---|---|---|
| Feed-Stock | 100.00 | 22.70 | 100.00 |
| Floating F1 (sterile) | 48.03 | 11.80 | 24.96 |
| Non-floating NF1 (roughing concentrate) | 51.97 | 32.78 | 75.04 |

The roughing concentrate consisting of the non-floating fraction NF1 may be enriched by a further flotation step intended to remove into the froths the residual carbonates. This fraction is conditioned in sea-water pulp at a solid concentration of 15% with the phosphoric ester LP9A at a 400 g/t dosage during 1 minute (pH: 7.20); the conditioned pulp is then subjected to a depletion flotation which provides a mixed floating fraction F2 and a non-floating fraction $NF_2$.

The material and phosphate balances of this further flotation step are as follows: (table V):

TABLE V

| | Ponderal yield Δ P % | $P_2O_5$ content % | $P_2O_5$ recovery % |
|---|---|---|---|
| Mixed F2 | 14.79 | 24.7 | 16.09 |
| Final concentrate (F3) | 37.18 | 36.0 | 58.95 |

The final concentrate contains 94.7% of apatite.

The above examples 1 and 2 show that this process for flotation of the carbonates by phosphoric esters leads to good recovering results in a sea-water medium. Some prior art processes used in sea-water, led with the ore of examples 1 and 2 to bad separations.

Thus, by applying to said ore the known process with phosphate depression by $SIF_6^{2-}$and flotation of the carbonates by emulsified oleic acid, while using 1000 g/t of $Na_2SiF_6$ and 3000 g/t of oleic acid, the following results (table VI) were obtained.

TABLE VI

| | Ponderal yield Δ P % | $P_2O_5$ content % | $P_2O_5$ recovery % |
|---|---|---|---|
| Floating (sterile) | 14.20 | 12.99 | 11.08 |

TABLE VI-continued

| | Ponderal yield Δ P % | $P_2O_5$ content % | $P_2O_5$ recovery % |
|---|---|---|---|
| Non-floating (concentrate) | 85.80 | 17.25 | 88.92 |
| Feed-stock | 100.00 | 16.65 | 100.00 |

By applying to the same ore the known process with depression of the phosphate by alumine sulphate and sodium-potassium tartrate, and flotation of the carbonates by sodium oleate, while using: 1760 g/t of 96% $H_2SO_4$ 250 g/t of $Al_2(SO_4)_3$–500 g/t of sodium-potassium tartrate 5000 g/t of sodium oleate, the following results (table VII) were obtained.

TABLE VII

| | Ponderal yield Δ P % | $P_2O_5$ content % | $P_2O_5$ recovery % |
|---|---|---|---|
| Floating (sterile) | 8.43 | 11.65 | 5.69 |
| Non-floating (concentrate) | 91.57 | 17.78 | 94.31 |
| Feed-stock | 100.00 | 17.26 | 100.00 |

EXAMPLE 3

3a Another sample of the same phosphate as in examples 1 and 2, having a $P_2O_5$ grade of about 24% and a −315+40 μm grain-size, is conditioned in a fresh water pulp including 15% of solids (pH: 7.61) successively with:

$Na_2SiF_6$ at a 1000 g/t dosage during 1 minute (pH: 6.30)

a phosphoric ester GERLAND Beycostat DA at a 2500 g/t dosage for 2 minutes (pH 6.20)

The thus conditioned pulp is subjected to a roughing flotation for 2 minutes. The material and phosphate balances are the following: (Table VIII).

TABLE VIII

| | Ponderal yield Δ P % | $P_2O_5$ content % | $P_2O_5$ recovery % |
|---|---|---|---|
| Feed-stock | 100.00 | 24.57 | 100.00 |
| Floating F1 (sterile) | 49.60 | 16.00 | 32.30 |
| Non-floating NF1 (concentrate) | 50.40 | 33.00 | 67.70 |

3b On this same sample the DA collector is replaced by the phosphoric ester GERLAND Beycostat LP9A at a 1500 g/t dosage (pH during conditioning: 6.47). The other conditions being identical with example 3a), the balances for the flotation separation are the following (table IX).

TABLE IX

| | Ponderal yield Δ P % | $P_2O_5$ content % | $P_2O_5$ recovery % |
|---|---|---|---|
| Feed-stock | 100.00 | 23.46 | 100.00 |
| Floating F1 (sterile) | 56.32 | 15.90 | 38.18 |
| Non-floating NF1 (concentrate) | 43.68 | 33.20 | 61.82 |

3c The sodium fluosilicate (+) used as a phosphate depressor in examples 3a and 3b is replaced by 96% sulphuric acid of technical grade at a 6000 g/t dosage (pH during conditioning: 5.79). The other flotation conditions being identical with those of example 3b), the balances are then the following (table X).

TABLE X

| | Ponderal yield Δ P % | $P_2O_5$ content % | $P_2O_5$ recovery % |
|---|---|---|---|
| Feed-stock | 100.00 | 24.35 | 100.00 |
| Floating F1 (sterile) | 55.34 | 17.30 | 39.31 |
| Non-floating NF1 (concentrate) | 44.66 | 33.10 | 60.69 |

3d The collector LP9A being at a 1000 g/t dosage (pH during conditioning: 6.41) and the other flotation conditions being identical with those of example 3b), the separation balances are the following: (table XI).

TABLE XI

| | Ponderal yield Δ P % | $P_2O_5$ content % | $P_2O_5$ recovery % |
|---|---|---|---|
| Feed-stock | 100.00 | 24.20 | 100.00 |
| Floating F1 (sterile) | 46.15 | 15.68 | 29.91 |
| Non-floating NF1 (concentrate) | 53.85 | 31.50 | 70.09 |

EXAMPLE 4

The fraction of a −316+50 μm grain-size separated from a sample of attritioned ore of the DJEBEL ONK (Algeria) and containing dolomite, is treated by double reverse flotation for successive removal of the dolomite, then of the silica.

The ore in a 15%-solids fresh water pulp (pH: 7.30) is conditioned with:

a sodium fluosilicate at a 1000 g/t dosage during 2 minutes (pH: 5.70)

a phosphoric ester Beycostat LP9A of GERLAND at a 275 g/t dosage during 2 minutes (pH: 5.79).

The conditioning pulp is subjected to a roughing flotation for 3 minutes, giving a dolomite-enriched floating fraction F1. The pulp remaining in the cell is conditioned with a further addition of LP9A at a 100 g/t dosage for 2 minutes, then it is subjected to a depletion flotation for 3 minutes, giving a dolomite-enriched floating fraction F2.

The pulp remaining in the cell is filtered for removing water which contains soluble residues of reagents for the carbonate flotation. The filtered product is converted into a fresh water pulp with a 15% solid content, this pulp is conditioned (pH: 7.40) for 2 minutes by a collector for silica under the form of an amine acetate marketed by C.E.C.A. (Carbonisation et Charbons Actifs) under the name Noramac C, at a 500 g/t dosage. The pulp is floated for 3 minutes, giving a silica-enriched floating fraction F3 and a phosphate-enriched, dolomite- and silica-depleted non-floating fraction NF3.

The balances of the separations are set forth in the following table: (table XII).

Most of the residual carbonates in the concentrate are included as an endogangue in the phosphate-containing elements (pseudo-colithes) and cannot be removed by flotation. However, due to the residual MgO content of 0.75%, there may be obtained, by sulphuric attack of this concentrate, a phosphoric acid of good quality.

EXAMPLE 5

(5a). The fraction of a −200+40 μm grain-size separated from a sample of attritioned phosphate ore fom Egypt, containing dolomite, is treated by double reverse flotation for successive removal of dolomite, then of silica.

The ore as a fresh water pulp having a 15% solid content (pH: 6.32) is conditioned with:

sodium fluosilicate at a 1000 g/t dosage for 2 minutes (pH: 4.69).

a phosphoric ester BEYCOSTAT LP9A of GERLAND at a 400 g/t dosage for 3 minutes (pH: 5.11).

The conditioned pulp is subjected to a roughing flotation for 2 minutes, giving a dolomite-enriched floating fraction F1. The pulp remaining in the cell is further conditioned for 3 minutes by the collector LP9A at a 200 g/t dosage (pH: 6.14), then is subjected for 2 minutes to a first depletion flotation giving a dolomite-enriched floating fraction F2. The pulp remaining in the cell is conditioned for one minute by the LP9A collector at a 200 g/t dosage (pH: 6.14), then is subjected for 2 minutes to a second depletion flotation giving a dolomite-enriched floating fraction F3.

The pulp remaining in the cell is filtered, the wet cake is converted into a 15% solid fresh water pulp. The pulp is conditioned (pH: 6.90) for one minute by the collector NORAMAC C at a 400 g/t dosage, then it is subjected to a flotation for 3 minutes, giving a silica-enriched floating fraction F4 and a phosphate enriched, dolomite-and silica-depleted non floating fraction NF4.

The balances of the separations are set forth in the table XIII below.

5b. The ore fraction identical to that of example (5a) is treated according to the same process of flotation as that described in example (5a). The carbonate collector LP9A was replaced by the phosphoric ester GERLAND Beycostat NA at a dosage of 400 g/t for the roughing flotation and of 200 g/t during the depletion flotation. The other conditions for the flotations are identical to those described in example (5a). The balances of the separations are the following (table XIV).

TABLE XII

| | Ponderal yield Δ P % | $P_2O_5$ content % | $P_2O_5$ recovery % | $CO_2$ content % | $CO_2$ recovery % | MgO content % | MgO recovery % | $SiO_2$ content % | $SiO_2$ recovery % |
|---|---|---|---|---|---|---|---|---|---|
| Floating F1 | 8.80 | 19.00 | 5.84 | 21.50 | 22.44 | | | 2.35 | 15.00 |
| Floating F2 | 4.73 | 21.10 | 3.49 | 18.50 | 10.38 | 6.49 | 64.89 | | |
| Floating F3 | 4.08 | 20.60 | 2.94 | 11.60 | 5.61 | | | 15.50 | 29.83 |
| Non-floating NF3 | 82.39 | 30.50 | 87.74 | 6.30 | 61.57 | 0.75 | 35.11 | 1.42 | 55.17 |
| Feed-stock | 100.00 | 28.64 | 100.00 | 8.43 | 100.00 | 1.76 | | 2.12 | |

TABLE XIII

| | Ponderal yield Δ P % | $P_2O_5$ content % | $P_2O_5$ recovery % | $CO_2$ content % | $CO_2$ recovery % | MgO content % | MgO recovery % | $SiO_2$ content % | $SiO_2$ recovery u |
|---|---|---|---|---|---|---|---|---|---|
| Floating F1 | 3.63 | 3.90 | 0.50 | 41.85 | 23.04 | 15.58 | 33.38 | 0.98 | 1.32 |
| Floating F2 | 6.49 | 7.50 | 1.72 | 33.35 | 32.83 | 13.35 | 51.14 | 0.85 | 2.05 |
| Floating F3 | 4.09 | 27.50 | 3.98 | 8.65 | 5.37 | 2.05 | 4.95 | 1.40 | 2.13 |
| Floating F4 | 4.50 | 18.40 | 2.93 | 2.60 | 1.78 | 0.35 | 0.93 | 33.80 | 56.65 |
| Non-floating NF4 | 81.29 | 31.60 | 90.87 | 3.00 | 36.98 | 0.20 | 9.60 | 1.25 | 37.85 |
| Feed-stock | 100.00 | 28.27 | 100.00 | 6.59 | 100.00 | 1.69 | 100.00 | 2.69 | 100.00 |

TABLE XIV

| | Ponderal yield Δ P % | $P_2O_5$ content % | $P_2O_5$ recovery % | $CO_2$ content % | $CO_2$ recovery % | MgO content % | MgO recovery % | $SiO_2$ content % | $SiO_2$ recovery % |
|---|---|---|---|---|---|---|---|---|---|
| Floating F1 | 8.92 | 7.40 | 2.31 | 34.30 | 46.26 | 13.68 | 68.41 | | |
| Floating F2 | 3.90 | 18.30 | 2.49 | 19.75 | 11.65 | 7.38 | 16.14 | 7.37 | 46.15 |
| Floating F3 | 4.09 | 14.80 | 2.12 | 6.10 | 3.77 | 1.66 | 3.81 | | |
| Non-floating NF3 | 83.09 | 32.05 | 93.08 | 3.05 | 38.32 | 0.25 | 11.64 | 1.75 | 53.85 |
| Feed-stock | 100.00 | 28.61 | 100.00 | 6.61 | 100.00 | 1.78 | 100.00 | 2.70 | 100.00 |

(5c The ore fraction identical with that of example 5a) is treated according to the same flotation process as that described in examples (5a) and (5b). The phosphate depressor, viz sodium fluosilicate, used in examples (5a) and (5b) was replaced by fluosilicic acid $H_2SiF_6$ of technical grade in a solution of a density d=1.29 g/cm$^3$, at a 1000 g/t dosage. The phosphoric ester used as a collector for the carbonates is Beycostat LP9A at a dosage of 400 g/t for the roughing flotation, then of 200 g/t for the carbonate-depleting flotation. The other conditions for flotations are identical with those described in example (5a). The balances of the separations are the following (table XV).

5d: The 96% sulfuric acid of technical grade was used as phosphate depressor in the carbonate separation; it was at a 1000 g/t dosage. The other flotation conditions are identical to the ones described in example 5c. The balances of the separation are presented in the table XVI below.

Of course the invention is not limited by the above examples, which are purely illustrative.

TABLE XV

| | Ponderal yield Δ P % | $P_2O_5$ content % | $P_2O_5$ recovery % | $CO_2$ content % | $CO_2$ recovery % | MgO content % | MgO recovery % |
|---|---|---|---|---|---|---|---|
| Floating F1 | 10.00 | 6.8 | 2.40 | 37.95 | 52.65 | 14.09 | 75.26 |
| Floating F2 | 8.06 | 25.2 | 7.17 | 11.20 | 12.53 | 3.56 | 15.32 |
| Floating F3 | 7.37 | 23.9 | 6.22 | 3.70 | 3.78 | 0.37 | 1.46 |
| Non-floating $NF_3$ | 74.57 | 32.0 | 84.21 | 3.00 | 31.04 | 0.20 | 7.96 |
| Feed-stock | 100.00 | 28.33 | 100.00 | 7.21 | 100.00 | 1.87 | 100.00 |

TABLE XVI

| | Ponderal yield Δ P % | $P_2O_5$ content % | $P_2O_5$ recovery % | $CO_2$ content % | $CO_2$ recovery % | MgO content % | MgO recovery % |
|---|---|---|---|---|---|---|---|
| Floating F1 | 12.41 | 9.5 | 4.16 | 31.15 | 55.57 | 12.35 | 80.41 |
| Floating F2 | 5.04 | 25.4 | 4.52 | 10.00 | 7.24 | 3.15 | 3.33 |
| Floating F3 | 5.23 | 21.3 | 3.93 | 2.90 | 2.18 | 0.41 | 1.12 |
| Non-floating $NF_3$ | 77.32 | 32.0 | 87.38 | 3.15 | 35.01 | 0.25 | 10.14 |
| Feed-stock | 100.00 | 28.31 | 100.00 | 6.96 | 100.00 | 1.91 | 100.00 |

What we claim is:

1. A process for the treatment of reverse flotation of phosphate ores of the carbonate or silico-carbonate gangue type, characterized by the steps of:

(1) forming a feed suspension of the ore and conditioning the feed suspension with a depressor to depress the phosphate compounds contained in the ore, (2) treating the conditioned feed suspension from step (1) with a collector essentially comprising a phosphoric ester, in a quantity sufficient to effect flotation of the carbonates, and (3) separating by flotation the carbonates contained within the feed suspension and separating from the suspension a flotation residue containing the phosphate compounds.

2. Process according to claim 1, wherein the depressor for the phosphate compounds, in step (1) is selected from the group consisting of fluosilicates, monometallic phosphates, sulfuric acid, and phosphoric acid.

3. Process according to claim 1, characterized in that the solid matter concentration of the conditioned ore in step (1) is within the range of about 10% to about 20% by weight of feed-ore.

4. Process according to claim 1, characterized in that the duration of the conditioning of step (1) is in the range of about 1 to 4 minutes.

5. Process according to claim 1, characterized in that the conditioning of the ore in step (1) is effected at the natural reaction pH of the depressor.

6. Process according to claim 1, characterized in that the phosphoric ester in step (2) is a polyoxyalkyline phosphoric ester.

7. Process according to claim 1, characterized in that the solid concentration of the conditioned ore in step (2) is within the range of about 10% to 20% by weight of feed-ore.

8. Process according to claim 1, characterized in that the duration of the treating of the conditioned ore in step (2) is in the range of about 1 to 4 minutes.

9. Process according to claim 1, characterized in that the dosage of phosphoric esters in step (2) ranges from about 100 to 2500 g per ton of ore.

10. Process according to claim 1, characterized in that the process may be entirely carried out in sea-water medium.

11. Process according to claim 1, characterized in that sulphuric acid is used as a depressor for the phosphates.

12. Process according to claim 1, wherein the pH in the conditioning of the ore in step (1) is adjusted to about 4.5 to 6.

13. Process according to claim 1, wherein the depressor in step (1) is added in an amount of about 500 to 1500 per ton of ore when the depressor is at least one of a fluosilicate and a monometallic phosphate.

14. Process according to claim 1, wherein the depressor is added in an amount of about 1 kg to 10 kg per ton of ore when the depressor is at least one of a phosphoric acid and a sulphuric acid.

15. Process according to claim 1, wherein the phosphoric ester in step (2) in a polyoxyethylene ester having a $C_8$–$C_{20}$ hydrocarbon chain and 4 to 12 molecules of ethylene oxide per mole of ester.

16. Process according to claim 1, characterized in that the flotation separation of the carbonates in step (3) is performed as one roughing flotation.

17. Process according to claim 11, further characterized by one or more depletion flotations of the flotation residue of the rough flotation to remove any carbonates still contained in the flotation residue, prior to the depletion flotations the flotation residue of the rough flotation is conditioned with a collector for carbonates essentially comprising a phosphoric ester and a depressor for the phosphate.

18. Process according to claim 17, characterized in that the duration of the conditioning of the rough flotation is in the range of about 1 to 4 minutes, and the solid concentration of the flotation residue after conditioning is within the range of about 10 to 20% by weight.

19. Process according to claim 1, further characterized by the conditioning of the flotation residue of step (3) with a cationic collector and separating by flotation the silicates from the flotation residue containing the phosphates.

20. Process according to claim 19, characterized in that the flotation residue resulting from step (3) is concentrated up to about a 50 to 70% solid content and then rediluted with water to a concentration of about 10 to 20% solid content by weight before being conditioned by the cationic collector.

21. Process according to claim 19, wherein the cationic collector is selected from the group consisting of a primary amine and a primary amine salt.

22. Process according to claim 19 wherein the conditioning of the flotation residue with a cationic collector is performed at a pH within the range of 6.5 to 8.

23. Process according to claim 1, wherein the depressor for the phosphate compound in step (1) is sodium fluosilicate.

24. Process according to claim 23, wherein the pH in the conditioning of the ore in step (1) is adjusted to about 5.5 to 7.5.

25. Process according to claim 1, wherein the depressor for the phosphate compound in step (1) is monosodium phosphate.

26. Process according to claim 25, wherein the pH in the conditioning of the ore in step (1) is adjusted to about 5.5 to 7.5.

* * * * *